US005419228A

United States Patent [19]

Garrett et al.

[11] Patent Number: 5,419,228

[45] Date of Patent: May 30, 1995

[54] MUSICAL INSTRUMENT PICK WITH MULTIPLE PLAYING SURFACES

[76] Inventors: Billy D. Garrett; Sandra S. Garrett, both of Rte. 1, Box 202, Poplar Bluff, Mo. 63901

[21] Appl. No.: 158,567

[22] Filed: Nov. 29, 1993

[51] Int. Cl.[6] ..... G10D 3/16

[52] U.S. Cl. ..... 84/322

[58] Field of Search ..... 84/320, 322

[56] References Cited

U.S. PATENT DOCUMENTS

| | | | |
|---|---|---|---|
| D. 292,413 | 10/1987 | Slusser | D17/20 |
| 555,599 | 3/1896 | Essig | 84/322 |
| 655,959 | 8/1900 | Cochrane | 84/322 |
| 998,440 | 7/1911 | Willat | 84/322 |
| 4,150,601 | 4/1979 | Henley, Jr. | 84/322 |
| 4,691,609 | 9/1987 | Acocella | 84/322 |
| 5,307,722 | 5/1994 | La Rosa | 84/322 |

*Primary Examiner*—M. L. Gellner
*Assistant Examiner*—Patrick J. Stanzione
*Attorney, Agent, or Firm*—Jacobson, Price, Holman & Stern

[57] ABSTRACT

A musical instrument pick including a metal bar extending along the top of a conventionally shaped pick body. At one end of the metal bar, there is a rounded bevelled end which is used by holding the pick upside down at an angle of 45°. The bevelled end is used to perform arpeggio sweeps. At the opposite end of the metal bar, a tapered surface terminating in a point is provided for fast picking. On lateral surfaces of the metal bar are provided grooves for receiving the thumb and forefinger, respectively, of the user. The top edge of the metal bar is rounded useful to perform "slide" and "finger tapping" techniques.

6 Claims, 1 Drawing Sheet

MUSICAL INSTRUMENT PICK WITH MULTIPLE PLAYING SURFACES

FIELD OF THE INVENTION

The present invention relates to a pick for string instruments, and more particularly to a musical instrument pick having multiple surfaces for tap and slide styles of guitar playing.

BACKGROUND OF THE INVENTION

TO play certain string musical instruments, such as guitars and mandolins, a "pick" is used to hit a string or strum strings of the instrument. The shape and surfaces of the pick to some degree dictate the types of sounds that may be created from the instrument. For example, a sharp surface is desired to make rapid single string picking in sequence, whereas a smooth surface is desirable when strumming several strings. Other techniques have evolved that are performed by finger, but which would be enhanced with the use of a pick. For example, a technique called "finger tapping" involves attacking a string with one finger of the picking hand to slam the string onto the fretboard of the guitar and pulling the string off at a slight angle. The sound of the string at the fret where it is tapped is created followed by the sound of the string "open", when the string is released. This creates an "arpeggio" type of sound.

As an example of musical instrument picks with uniquely shaped surfaces, see U.S. Pat. Nos. 555,599 to Essig, 655,959 to Cochrane, 4,691,609 to Acocella and Des. 292,413 to Slusser. In addition, U.S. Pat. Nos. 998,440 to Willat and 4,150,601 to Henley, Jr. disclose picks with specialized structures for facilitating gripping of the pick.

SUMMARY OF THE INVENTION

The present invention is directed to a musical instrument pick having multiple surfaces each designed for a particular style of play. Specifically, the pick according to the present invention features a metal bar extending along the top of a conventionally shaped pick body. At one end of the metal bar, there is a rounded bevelled end which is used by holding the pick upside down at an angle of 45°. The bevelled end is used to perform a style of play called "arpeggio sweeps". At the opposite end, a tapered surface terminating in a point is provided for "speed picking". On lateral surfaces of the metal bar are provided grooves for receiving the thumb and forefinger, respectively, of the user. The top edge of the metal bar is rounded to perform "slide" as well as "finger tapping" techniques. The metal bar is very durable and produces a cleaner, sharper, and more distinct tone than a plastic picking surface. Of course, the various pick surfaces could be used to perform various other picking techniques which may or may not be now known.

The pick according to the present invention is versatile. It fits the needs of all types of musicians and all styles of play.

It is a primary object of the present invention to provide a durable and versatile musical instrument pick having multiple surfaces, each designed for particular styles of play.

The above and other objects and advantages which will become more readily apparent reside in the details of structure and operation as more fully hereinafter described and claimed, reference being made to the following description taken in conjunction with the accompanying drawings.

DETAILED DESCRIPTION OF THE PREFERRED EMBODIMENT

Figure 1:
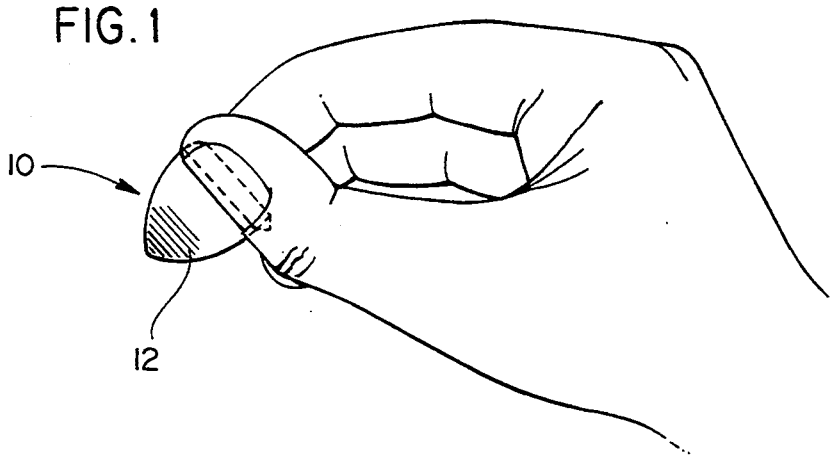
FIG. 1 is a perspective view of the pick according to the present invention, held by the finger of a user.
Figure 2:
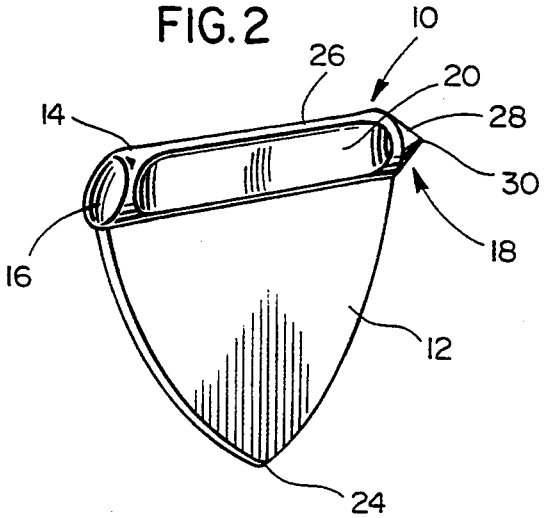
FIG. 2 is a perspective view of the pick according to the present invention.
Figure 3:
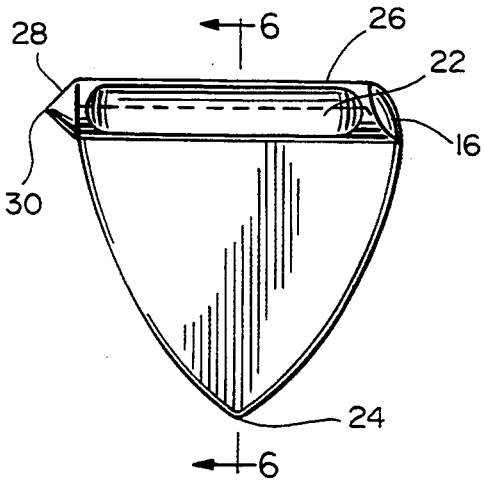
FIG. 3 is a side view of the pick.
Figure 4:
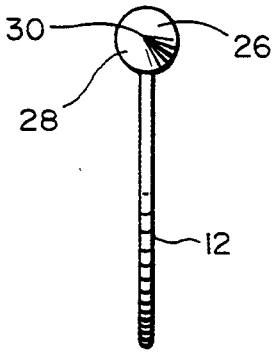
FIGS. 4 and 5 are end views of the pick.
Figure 5:
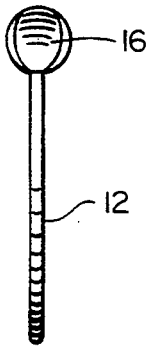
Figure 6:
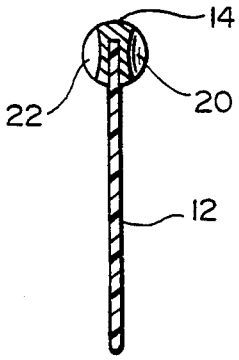
FIG. 6 is a cross sectional view of the pick taken through line 6—6 of FIG. 3.

Referring to FIGS. 1–6, the inventive pick is shown at 10, and comprises a plastic pick body 12 and a rigid metal bar 14. The metal bar 14 comprises a rounded bevelled end 16, a tapered end 18 and two grooves 20 and 22 on opposite faces. The pick body 12 is substantially flat and may have a conventional triangular shape. The body 12 may have a point 24 which is used for conventional picking and strumming techniques. The metal bar 14 further comprises a rounded top edge 26. The metal bar 14 may be formed separately from the pick body, having a slot therein which is secured to the top edge of the pick body 12. The bar 14 is preferably made of metal or steel, but other hard and durable materials may suffice, but would give different sounds or tones.

The features of the pick according to the invention are embodied on various surfaces of the pick, and in particular, the metal bar 14. These surfaces are designed to accommodate and enhance certain styles of play.

The bevelled end 16 is a substantially smooth end of the metal bar, useful for a style of play called "arpeggio sweeps". The bevelled end is formed at approximately a 45° angle with respect to the top surface 26 of the metal bar° The "arpeggio sweep" technique involves holding the pick upside down at a 45° angle, allowing movement for pressure be applied to one string against the fretboard so that the rounded end 16 can roll from one string to another. Pressing the string onto the fret and rolling quickly from one string gives a clear tone and sound to each string the end 16 crosses. When learning this technique, it is useful to mute all of the strings with the left hand. An unlimited variety of sounds can be produced by mapping different sweeps of the bevelled end 16 across the fretboard from one string to another, allowing each individual string to produce a tone.

The pointed end 18 of the pick comprises a smooth conical tapered surface 28 which terminates in a sharp point 30. This end of the bar 14 is used for a technique called "speed picking". By holding the point 30 preferably aimed straight at the string, the point may be used to pick strings very quickly, and more easily than a standard pick because it has less friction than a standard pick. The point 30 may be aimed straight at the strings, or at various angles. Moreover, the pick may be oriented in the hand of the user as shown in FIG. 1, or turned in the thumb and finger with the body 12 resting against the thumb and forefinger horizontally, so that the point extends outward from the hand.

The rounded top 26 of the metal bar 14 has two advantageous uses, and when it is used, the pick is rotated 180° from the normal orientation shown in FIG. 1.

The first use of the top 26 is to improve the style of play called "finger tapping". The steel or metal bar replaces the finger, and is performed by attacking one string with one finger of the picking hand, slamming the string onto the fretboard and pulling off the pick at a slight angle. This activates the sound of the string at the fret where it is tapped, and the sound of the same string "open" when released. Repeating this technique quickly creates an "arpeggio" type of sound.

Finger tapping with the metal bar makes the style of play more enjoyable and improves string vibration reaction to give a clearer, sharper and more distinct tone. Moreover, the speed of this technique is greatly improved.

The rounded top 26 can also be used to achieve various slide techniques. This technique is performed by hitting one or more strings at a time, similar to a tapping technique, then sliding either up or down the neck of the instrument, producing sounds similar to a standard style of slide guitar. The rounded top 26 allows the left hand the freedom from holding a slide bar, which is particularly inconvenient when playing live before an audience when it would otherwise be necessary to reach into a pocket for a slide bar.

In addition, the rounded top 26 can be used to make "chromatic rakes", whereby the top 26 is used to hit a fret and glide past several frets and back again very quickly to generate sounds of chromatic scale progressions.

The grooves 20 and 22 are cut along a substantial portion of the length of the bar 14 and terminate at smooth curves. The grooves are designed make easier gripping of the pick with the thumb and fingers, usually the forefinger, as shown in FIG. 1.

It is to be understood that the foregoing description and accompanying drawings should be considered illustrative only of the principles of the invention. Since numerous modifications will readily occur to those skilled in the art, it is not desired to limit the invention to the exact construction and operation shown and described, and, accordingly, all suitable modifications and equivalents may be resorted to, falling within the scope of the invention.

We claim:

1. A musical instrument pick comprising:

a pick body having a general triangular shape including a top edge at which the pick body is held, and a bottom point for picking strings of a musical instrument;

a rigid metal bar formed at the top edge of the pick body, said rigid metal bar comprising:

a top facing surface which is substantially rounded;

a bevelled surface at one end of the metal bar which is substantially rounded and smooth;

a smooth tapered surface terminating in a point at the other end of the bar; and first and second grooves on opposite lateral faces, respectively, for receiving the thumb and forefinger of a user.

2. A musical instrument pick comprising:

a pick body;

a rigid bar formed at an edge of the pick body and having two opposed ends, said rigid bar comprising:

a bevelled surface at one end thereof which is substantially rounded and smooth; and a smooth, conically tapered surface terminating in a point at the other, opposite end of the bar.

3. The musical instrument pick of claim 2, wherein said rigid bar is metal and further comprises a top facing surface which is substantially rounded.

4. A musical instrument pick comprising:

a pick body; and a rigid metal bar formed at an edge of the pick body and having a first playing surface for fast string picking, a second playing surface for slide and finger tapping styles of play, and a third playing surface for rolling across strings on a fretboard;

the first playing surface being a smooth tapered surface terminating in a point at one end of the bar, the second playing surface being an elongated rounded edge of the bar, and the third playing surface being a bevelled surface at an end of the bar opposite the first playing surface.

5. A musical instrument pick comprising:

a pick body, a rigid bar secured along an entire length of one edge of said pick body and extending beyond said one edge of said pick body, said rigid bar including two opposed ends with one end having a bevelled, substantially rounded and smooth surface and the other end having a smooth tapered surface terminating in a point.

6. A musical instrument pick according to claim 5, wherein said smooth tapered surface is conically shaped.

* * * * *